US006285169B1

(12) United States Patent
McEachern

(10) Patent No.: US 6,285,169 B1
(45) Date of Patent: Sep. 4, 2001

(54) SAG GENERATOR WITH SWITCH-MODE IMPEDANCE

(75) Inventor: Alexander McEachern, Oakland, CA (US)

(73) Assignee: Power Standards Lab., Emeryville, CA (US)

( * ) Notice: Subject to any disclaimer, the term of this patent is extended or adjusted under 35 U.S.C. 154(b) by 0 days.

(21) Appl. No.: 09/781,171

(22) Filed: Feb. 12, 2001

(51) Int. Cl.[7] ..... G05F 1/70
(52) U.S. Cl. ..... 323/209; 323/211
(58) Field of Search ..... 323/205, 209, 323/210, 211; 307/130

(56) References Cited

U.S. PATENT DOCUMENTS

| | | | | |
|---|---|---|---|---|
| 4,131,938 | | 12/1978 | Milberger et al. | 363/101 |
| 5,355,295 | * | 10/1994 | Brennen | 363/40 |
| 5,532,577 | * | 7/1996 | Doluca | 323/282 |
| 5,541,808 | * | 7/1996 | Bastian | 361/605 |
| 5,886,429 | | 3/1999 | Grady et al. | 307/125 |
| 5,920,132 | | 7/1999 | Rockfield et al. | 307/130 |
| 5,990,667 | | 11/1999 | Degeneff et al. | 323/258 |
| 6,118,676 | * | 9/2000 | Divan et al. | 363/34 |
| 6,215,202 | * | 4/2001 | Luongo et al. | 307/64 |

OTHER PUBLICATIONS

SEMI F47–0200, *Specification for semiconductor processing equipment, Voltage sag immunity*, SEMI (Semiconductor Equipment and Materials International, 805 East Middlefield Raod, Mountain View, CA 94043), Feb. 2000.

SEMI F42–0600, *Test method for semiconductor processing equipment, voltage sag immunity*, SEMI (Semiconductor Equipment and Materials International, 805 East Middlefield Raod, Mountain View, CA 94043), Jun. 2000.

* cited by examiner

*Primary Examiner*—Adolf Deneke Berhane

(57) ABSTRACT

A voltage sag generator for alternating current power systems intentionally creates power quality disturbances. The sag generator has a switch-mode impedance between its input and its output. Varying the duty-cycle of the switch-mode impedance causes voltage sags.

3 Claims, 3 Drawing Sheets

SAG GENERATOR WITH SWITCH-MODE IMPEDANCE

BACKGROUND OF THE INVENTION

It is often desirable to create power quality disturbances on alternating current systems. Such disturbances can be used, for example, to test the immunity of newly designed systems. For example, the SEMI-F47 standard, published by the industry association Semiconductor Equipment and Materials International, and the associated SEMI-F42-0600 testing standard, require that all semiconductor manufacturing equipment tolerate voltage sags to 50% of nominal for 200 milliseconds, to 70% of nominal for 500 milliseconds, and to 80% of nominal for 1 second. Devices that generate such sags for testing purposes are known as sag generators.

Transformer-based sag generators are well-known in the art. Grady et al. in U.S. Pat. No. 5,886,429 and Rockfield et al. in U.S. Pat. No. 5,920,132 disclose typical transformer-based sag generators. However, sag generators must be brought to the test location, so a key requirement for sag generators is portability. Transformer-based sag generators are heavy and awkward to transport.

Amplifier-based sag generators are also well-known in the art. SEMI F42-0600 in its "Related Information 1—Sag Generators" section discusses sag generators that consist of a power amplifier connected to a signal generator. However, such sag generators by their nature require multiple power conversions from alternating current to direct current and back to alternating current, with each conversion having power losses. Most implementations require transformer isolation. For these reasons, amplifier-based sag generators are generally limited to low power applications, and are often even heavier and more awkward to transport than transformer-based sag generators of equivalent output power.

In a sag generator, it is desirable to provide computer-controlled depth and duration of a sag. It is also, in many cases, desirable to provide a computer-controlled envelope of the sag, i.e. to allow the sag depth to vary in a controlled way during the sag. And it is also desirable to provide computer control of the phase angle at which the sag commences.

Typically, sag generators are rated by their nominal voltage and their maximum continuous current, for example 480 volts and 100 amps. Typically, portability of a sag generator is limited when it weighs more than 100 pounds: it becomes difficult to check as luggage on an airplane, and it becomes difficult for an individual to transport and set up.

OBJECTS AND ADVANTAGES

It is an object of this invention to provide a sag generator that is light and portable for high power applications.

It is a further object of this invention to provide a sag generator that allows automatic control of the sag depth, sag duration, sag envelopes and sag phase angle.

Still further objects and advantages will become apparent from a consideration of the ensuing description and accompanying drawings.

PREFERRED EMBODIMENT—DESCRIPTION

Figure 1:
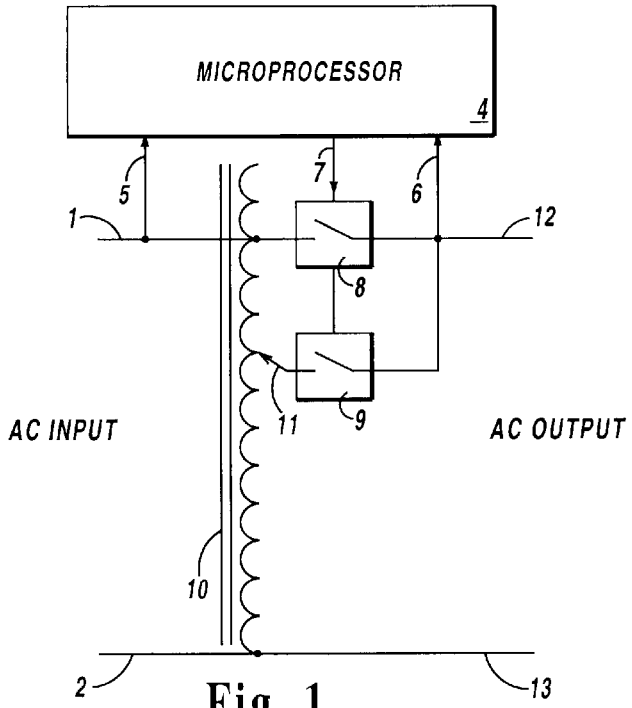
Fig. 1 (prior art)
FIG. 1 shows a prior-art sag generator, constructed with a variable transformer.

Turning first to FIG. 1, we see a prior art sag generator. An alternating current input 1,2 is modified by a variable transformer 10 controlled by a microprocessor 4 to produce a sagged alternating current output 12,13. The variable transformer 10 is constructed as an auto-transformer with a manually-controlled wiper 11, such as the well-known Variac transformer manufactured by Superior Electric, Chicago, Ill. The microprocessor 4 may be equipped with analog inputs 5,6 for measuring the input and output voltages. The microprocessor is equipped with digital outputs 7 that control alternating current switches 8,9. These switches may be relays, contactors, or solid-state relays such as the H12D4850 relay manufactured by Crydom, San Diego, Calif. In operation of this prior-art sag generator, the user manually sets the position of the transformer wiper 11 to the desired sag voltage. The microprocessor 4 activates one switch 8 to provide non-sagged power to a load connected to the alternating current output 12,13. When a sag is desired, the microprocessor 4 opens one switch 8 and closes the other switch 9 for the duration of the desired sag. Such a duration might be determined, for example, by counting the number of alternating current cycles through one of the analog inputs 5, 6. At the conclusion of the desired sag, the microprocessor opens the sag switch 9 and closes the non-sagged switch 8.

It will be apparent to one familiar with the art that a variable transformer of the type considered in the prior art of FIG. 1, rated for 480 volts and 100 amps, weighs substantially more than 100 pounds.

Figure 2:
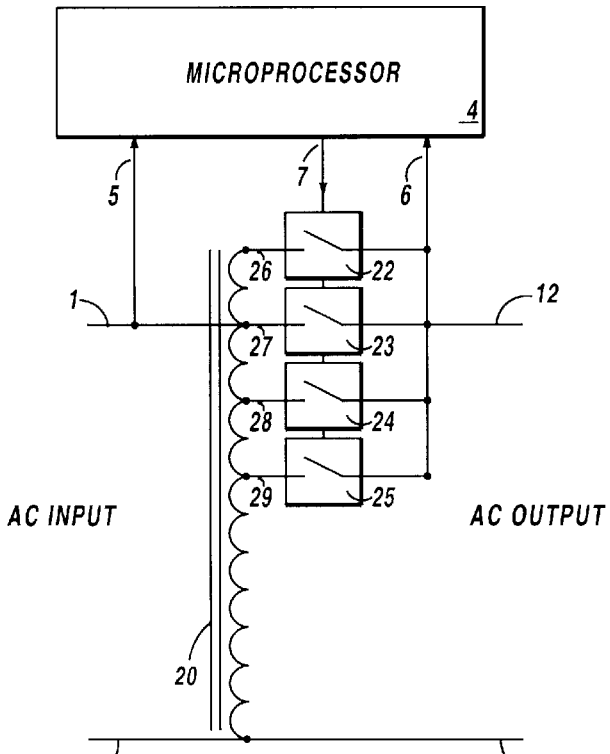
Fig. 2 (prior art)
FIG. 2 shows a prior-art sag generator, constructed with a tap-switched transformer.

Turning now to FIG. 2, we see another prior-art transformer-based sag generator. An alternating current input 1,2 is modified by a multiple-tap auto-transformer 20 equipped with multiple taps 26,27,28,29 controlled by a microprocessor 4 to produce a sagged alternating current output 12,13. The microprocessor 4 may be equipped with analog inputs 5,6 for measuring the input and output voltages. The microprocessor is equipped with digital outputs 7 that control alternating current switches 22,23,24,25. These switches may be relays, contactors, or solid-state relays such as the H12D4850 relay manufactured by Crydom, San Diego, Calif. In operation of this prior-art sag generator, the microprocessor 4 activates one switch 23 to provide non-sagged power to the load connected to the alternating current output 12,13. When a sag is desired, the microprocessor 4 opens one switch 23 and closes one of the other switches 22,24,25 for the duration of the desired sag. Such a duration might be determined, for example, by counting the number of alternating current cycles through one of the analog inputs 5, 6. At the conclusion of the desired sag, the microprocessor opens the selected sag switch 22,24,25 and closes the non-sagged switch 23. One familiar with the art will note that the prior-art sag generator shown in FIG. 2 is capable of generating negative sags, also known as voltage swells, using a transformer tap 26 that is higher than the nominal voltage tap 27. One familiar with the art will also note that, in contrast with the prior-art configuration of FIG. 1, the prior-art configuration of FIG. 2 provides computer-controlled selection of the output voltage, but provides limited sag depth resolution.

It will be apparent to one familiar with the art that a multiple-tap auto-transformer of the type considered in the prior art of FIG. 2, rated for 480 volts and 100 amps, weighs substantially more than 100 pounds.

Figure 3:
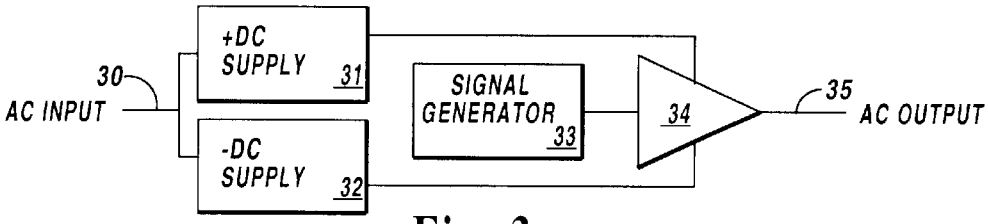
Fig. 3 (prior art)
FIG. 3 shows a prior-art sag generator, constructed as an amplifier-based topology.

Turning now to FIG. 3, we see a block diagram of a prior art amplifier-based sag generator, such as the AMX series of electronic power sources manufactured by Pacific Power of Huntington Beach, Calif. Such a sag generator accepts alternating current input power 30 and uses a pair of DC power supplies 31,32 to provide power to an amplifier 34. A signal generator 33, which may be controlled by a microprocessor, generates a signal that includes the desired voltage sag. This signal is amplified to high voltage and high current levels by the amplifier 34, and the alternating current output 35 of the amplifier contains the voltage sag. One familiar with the art will note that, in contrast with the prior-art configuration of FIG. 1 and FIG. 2, this prior-art configuration can provide frequency conversion (for example, the alternating current input 30 could be 60 Hertz and the alternating current output 35 could be 50 Hertz).

But it will be apparent to one familiar with the art that an amplifier-based sag generator of the type considered in the prior art of FIG. 3, rated for 480 volts and 100 amps, weighs substantially more than 100 pounds.

Figure 4:
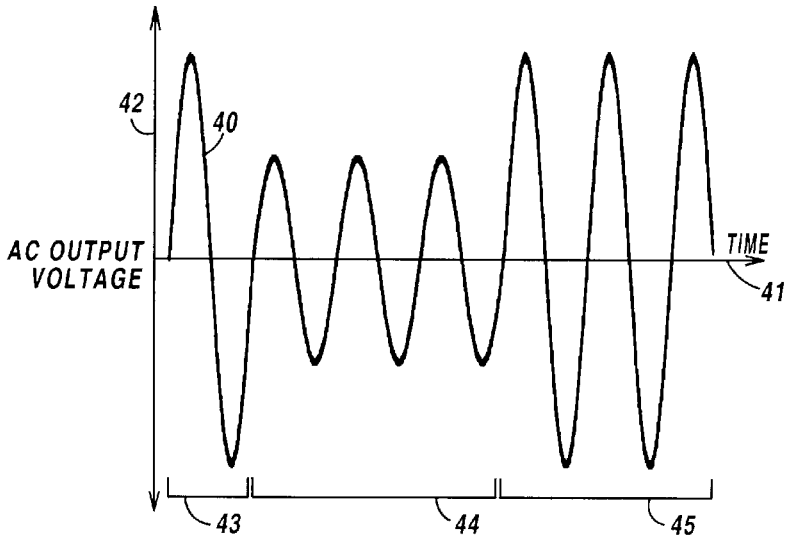
FIG. 4 shows a typical voltage sag waveform.

Turning now to FIG. 4, we see a typical desired output of a sag generator, presented as a voltage waveform 40 graphed on a horizontal time axis 41 and a vertical alternating current output voltage axis 42. During an initial time interval 43, the waveform shows nominal voltage. During a sag time interval 44, the waveform shows the sag voltage, in this case 50% of nominal for 3 cycles. The voltage returns to nominal in the post-sag interval 45.

Figure 5:
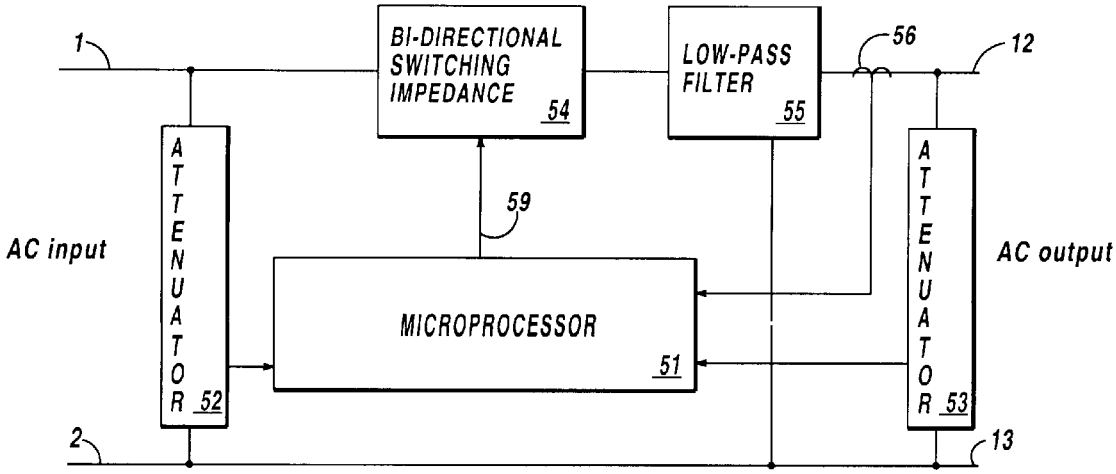
FIG. 5 shows a block diagram of the present invention, drawn in such a way as to conveniently contrast with prior art shown in FIG. 1 and FIG. 2.

Turning now to FIG. 5, we see the preferred embodiment of the present invention drawn in such a way as to conveniently contrast with the prior art of FIG. 1 and FIG. 2. An alternating current input 1,2 is modified by a bi-directional switching impedance 54, shown in more detail in FIG. 6 and controlled by a microprocessor 51, and operating through a low-pass filter 55 to produce a sagged alternating current output 12,13. The microprocessor 51 is equipped with analog inputs for measuring the instantaneous input and output voltages through a first attenuator 52 and a second attenuator 53, and for measuring the instantaneous output current through a current sensor 56. The current sensor 56 may be of any type well known in the art, such as a current transformer. The microprocessor 51 determines the desired instantaneous output voltage, and adjusts the characteristics of the bi-directional switching impedance 54 to obtain the desired instantaneous output voltage. The bi-directional switching impedance 54 is controlled by a duty-cycle varying digital signal 59 from the microprocessor 51, the frequency of which is at least an order of magnitude higher than the frequency of the alternating current input 1,2. The low-pass filter 55, which may take any form well-known in the art, and the details of which are not important to the present invention, removes the switching artifacts introduced by the bi-directional switching impedance 54. The microprocessor 51 can thus induce a voltage sag of the desired characteristics on the alternating current output 12,13.

Figure 6:
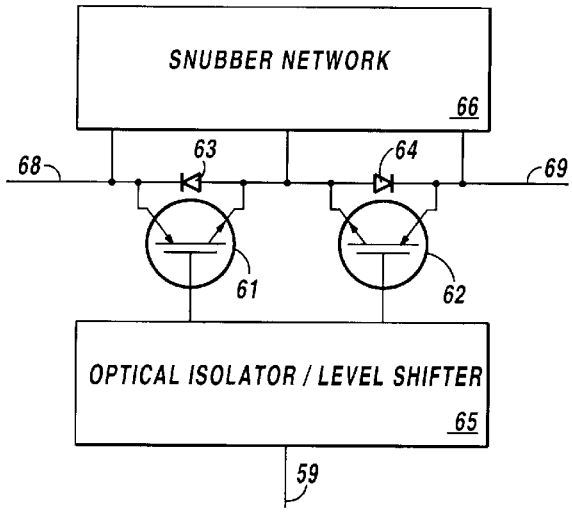
FIG. 6 shows details of a key element of the present invention, the bidirectional switching impedance.

Turning now to FIG. 6, we see the details of the preferred embodiment of the bi-directional switching impedance 54 of FIG. 5. Two Insulated Gate Bipolar Transistors (IGBT) 61,62 are placed back-to-back. Rectifiers 63,64 ensure that the correct polarity of current flows from the input line 68 to the output line 69 through each IGBT. The IGBT's 61,62 may be, for example, GA150KS61U manufactured by International Rectifier of El Segundo, Calif., and the rectifiers 63,64 may be any appropriate rectifier well-known in the art. The IGBT's 61,62 and their associated drive circuits are configured so that they function as switches, i.e. they are either fully in an on-state (fully saturated) or fully in an off-state. The transition time spent between the two states is minimized in order to minimize the power dissipation, as is well known in the art. In the preferred embodiment, an optical isolator/level shifter network 65 converts a low-level duty-cycle control signal 59, also seen in FIG. 5, on its input to appropriate drive levels for the IGBT's 61,62. The nature of such an optical isolator/level shifter network 65 is well known to those familiar with the art and is not critical to the present invention. A snubber network 66 bypasses the IGBT's. The nature and performance of such a snubber network 66 is well known to those familiar with the art and is not critical to the present invention.

By varying the duty cycle control signal 59 to between 0 and 100%, the impedance at low frequencies between the input line 68 and the output line 69 can be controlled, while maintaining minimal power dissipation in the IGBT's 61,62 and the rectifiers 63,64.

Figure 7A:
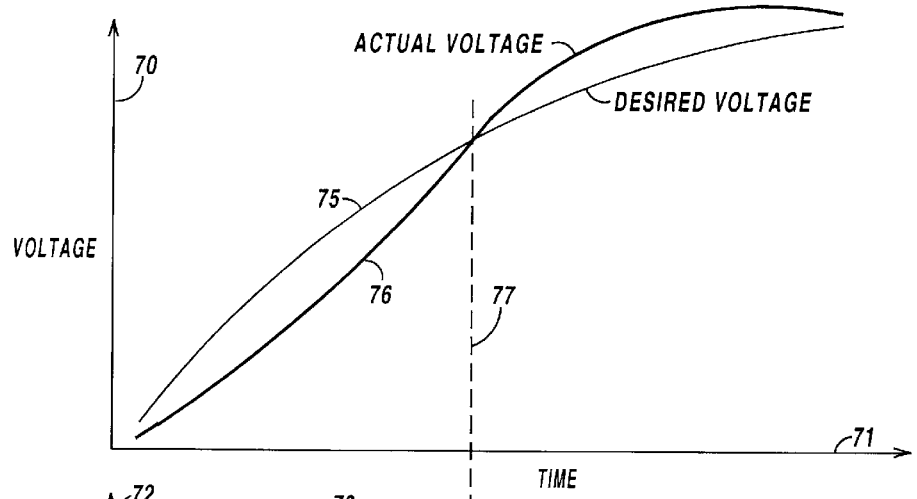
FIG. 7A and FIG. 7B show typical waveforms of the present invention.
Figure 7B:
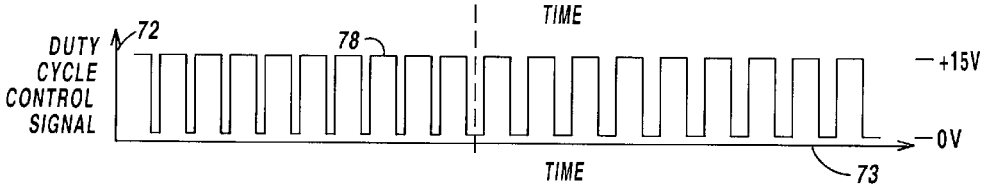

Turning now to FIGS. 7A and 7B, we see in FIG. 7A a graph of the instantaneous desired output voltage 75 and the instantaneous actual output voltage 76, plotted on a horizontal time axis 71 and a vertical voltage axis 70. We see in FIG. 7B a graph of a duty cycle control signal 78, plotted on a horizontal time axis 73 and a vertical voltage axis 72. The duty cycle control signal 78 is the signal that is driven on the input 59 of the switch mode impedance seen in FIG. 5 and FIG. 6. The instantaneous desired output voltage 75 of FIG. 7A is, in the preferred embodiment, calculated by the microprocessor 51 of FIG. 5 as a percentage of the instantaneous alternating current input voltage 1,2 of FIG. 5 as measured through the first attenuator 52 of FIG. 5. The instantaneous actual output voltage 76 of FIG. 7A is, in the preferred embodiment, measured by the microprocessor 51 of FIG. 5 through the second attenuator 53 of FIG. 5.

Returning our attention to FIG. 7A and FIG. 7B, prior to a certain point in time 77, the instantaneous desired output voltage 75 is higher than the instantaneous actual output voltage 76, so the duty cycle control signal 67 is driven high for a greater proportion of time, which reduces the apparent impedance of the bi-directional switching impedance of FIG. 6 and thus has the effect of increasing the instantaneous actual output voltage 76. After a certain point in time 77, the instantaneous actual output voltage 76 rises above the instantaneous desired output voltage 75, and the microprocessor therefore adjusts the duty cycle control signal 67 so that it is high for a lesser proportion of time, causing the instantaneous actual output voltage 76 to approach the instantaneous desired output voltage 75.

It will be recognized by those familiar with the art that the duty-cycle strategy illustrated in FIG. 7A and FIG. 7B applies only when the instantaneous output current is of the same polarity as the instantaneous output voltage 76; and that there are times in alternating current power systems when the instantaneous output current is of the opposite polarity as the instantaneous output voltage 76, unless the load is perfectly resistive; and that at those times a decrease in the apparent impedance of the bi-directional switching impedance of FIG. 6 causes a reduction in output voltage 76 instead of an increase in output voltage 76. For this reason, the microprocessor 51 of FIG. 5, which creates the duty cycle control signal 78 of FIG. 7B, may adjust its algorithm based on the polarity of the instantaneous current sensed by the current sensor 56 of FIG. 5.

Preferred Embodiment—Operation

In operation, the invention in the preferred embodiment shown in FIG. 5 is connected to a source of alternating current 1,2 and a load is connected to its alternating current output 12,13. The invention can then be programmed to deliver a voltage sag of any desired depth and duration to the load in the following way.

When no voltage sag is desired, the controller implemented in the preferred embodiment as a microprocessor 51 operates the duty cycle control signal 59 at 100% duty cycle, that is, the signal 59 is continuously high. This causes both IGBT's 61,62 to conduct continuously, and the alternating current output 12,13 is essentially the same as the alternating current input 1,2 (less the unimportant forward voltage drop of the rectifiers 63,64).

If it is desired to switch the output off, the controller implemented in the preferred embodiment as microprocessor 51 can adjust the duty cycle control signal 67 to 0% duty cycle, that is, the signal 59 is continuously low.

When a voltage sag is desired, the microprocessor 51 first determines the instantaneous desired output voltage by calculating, for example, a voltage that is a percentage of the instantaneous input voltage as measured through the first attenuator 52. The microprocessor 51 then compares this desired voltage with the instantaneous actual output voltage as measured through the second attenuator 53.

If the desired voltage is lower than the actual voltage, and the instantaneous current is the same polarity as the actual voltage, the microprocessor 51 reduces the duty cycle of the duty cycle control signal 78. If the instantaneous current is the opposite polarity as the actual voltage, the microprocessor 51 increases the duty cycle of the duty cycle control signal 78.

If, on the other hand, the desired voltage is higher than the actual voltage, and the instantaneous current is the same polarity as the actual voltage, the microprocessor 51 increases the duty cycle of the duty cycle control signal 78. If the instantaneous current is the opposite polarity as the actual voltage, the microprocessor 51 decreases the duty cycle of the duty cycle control signal 78.

These adjustments to the duty cycle of the duty cycle control signal 78 accommodate both the desired voltage sag and any changes in current required by the load.

It will be apparent to one familiar with the art that there is a negative feedback loop that operates through the microprocessor 51, the duty cycle control signal 59, and the low-pass filter 55, and that there are at least two sources of poles and nodes in the feedback loop: the low-pass filter 55 and the software strategy for shifting the duty cycle control signal 78. It will also be apparent to one familiar with the art that this feedback loop should operate substantially faster than changes in the load current if undesirable glitches in the output voltage are to be avoided.

In the preferred embodiment, changes in the load current are assumed to have frequency components below fifty times the nominal frequency of the alternating current input 1,2. The low-pass filter 55 is therefore set with a pass band knee approximately at this frequency, and the frequency of the duty cycle control signal 78 is set to approximately one order of magnitude higher than this frequency. In the preferred embodiment, the nominal frequency of the alternating current input 1,2 is approximately 60 Hertz; the maximum frequency component of current is assumed to be approximately 3 kHz; the pass-band knee of the low-pass filter 55 is set to approximately 3 kHz; and the frequency of the duty cycle control signal 78 is set to approximately 30 kHz. It will be recognized by those familiar with the art that other frequencies and filter characteristics will produce stable and desirable results.

It will be recognized by those familiar with the art that the sag generator of FIG. 5, with a rating of 480 Volts and 100 Amps nominal, can be constructed with a weight of less than 30 pounds, or much less than one-third the weight of comparable prior-art sag generators, greatly increasing its portability. It will also be recognized by those familiar with the art that such a sag generator has the programmable ability to set the depth, duration, envelope, and phase angle of voltage sags.

Other Embodiments

It will be apparent to one familiar with the art that other useful embodiments of the invention are possible. The function of the optical isolator/level shifter 65 may be performed by any of the means well known in the art, such as transformer isolation. Three-phase embodiments may be readily implemented. A bi-directional switching impedance 54 can be placed in a plurality of the alternating current conductors in a single alternating current system. The functions performed by the microprocessor 51 in the preferred embodiment may be performed by other arrangements of digital and analog devices, such as digital signal processors, analog filters, and programmable logic. Various other modifications may be made to the preferred embodiment without departing from the spirit and scope of the invention as defined by the appended claims.

I claim:

1. An apparatus for creating voltage sags on an alternating current power system, said apparatus comprising:

a. an input means capable of accepting alternating current voltage, such alternating current voltage having at least one nominal frequency;

b. an output means capable of delivering alternating current voltage;

c. a controlled impedance means between the input means and the output means, such controlled impedance means having an on-state and an off-state;

d. the controlled impedance means having a duty cycle of the on-state between 0% and 100%, such duty cycle switching between the on-state and the off-state at a switching frequency greater than ten times the nominal frequency.

2. An apparatus for creating voltage sags on an alternating current power system, said apparatus comprising:

a. an input means capable of accepting alternating current voltage, such alternating current voltage having at least one nominal frequency;

b. an output means capable of delivering alternating current voltage;

c. a controlled impedance means between the input and the output, such controlled impedance means having an on-state and an off-state and an associated duty cycle, such duty cycle switching between the on-state and the off-state at a frequency greater than ten times the nominal frequency;

d. such duty cycle controlled by a controller means, such controller means incorporating a plurality of signals, at least one of such signals being a measured voltage signal connected to the output means.

3. An apparatus for creating voltage sags on an alternating current power system, said apparatus comprising:

a. an input means capable of accepting alternating current voltage, such alternating current voltage having at least one nominal frequency;

b. an output means capable of delivering alternating current voltage;

c. a controlled impedance means between the input means and the output means, such controlled impedance means having an on-state and an off-state and an associated duty cycle, such duty cycle switching between the on-state and the off-state at a frequency greater than ten times the nominal frequency;

d. such duty cycle controlled by a controller means, such controller means incorporating a plurality of signals, such signals including both a measured instantaneous voltage signal at the output means and a measured instantaneous current signal at the output means.

* * * * *